US008916759B2

(12) United States Patent
Hashimoto

(10) Patent No.: US 8,916,759 B2
(45) Date of Patent: Dec. 23, 2014

(54) ACOUSTIC DRUM

(71) Applicant: Yamaha Corporation, Hamamatsu-Shi, Shizuoka-Ken (JP)

(72) Inventor: Ryuji Hashimoto, Hamamatsu (JP)

(73) Assignee: Yamaha Corporation, Hamamatsu-Shi, Shizuoka-Ken (JP)

( * ) Notice: Subject to any disclaimer, the term of this patent is extended or adjusted under 35 U.S.C. 154(b) by 0 days.

(21) Appl. No.: 14/025,329

(22) Filed: Sep. 12, 2013

(65) Prior Publication Data

US 2014/0069257 A1 Mar. 13, 2014

(30) Foreign Application Priority Data

Sep. 13, 2012 (JP) ..... 2012-201860

(51) Int. Cl.
*G10D 13/02* (2006.01)

(52) U.S. Cl.
CPC ..... *G10D 13/027* (2013.01); *G10D 13/02* (2013.01); *G10D 13/022* (2013.01)
USPC ..... 84/411 R; 84/416

(58) Field of Classification Search
CPC .... G10D 13/027; G10D 13/02; G10D 13/022
See application file for complete search history.

(56) References Cited

U.S. PATENT DOCUMENTS

| | | | | | |
|---|---|---|---|---|---|
| 879,521 | A | * | 2/1908 | Chein | 84/420 |
| 1,654,592 | A | * | 1/1928 | Lockwood | 84/411 R |
| 1,809,050 | A | * | 6/1931 | Logan | 84/414 |
| 4,308,782 | A | * | 1/1982 | Hartry | 84/414 |
| 4,325,281 | A | | 4/1982 | Hardy | |
| 4,567,807 | A | | 2/1986 | Robinson | |
| 4,589,323 | A | | 5/1986 | Belli et al. | |
| 4,742,753 | A | | 5/1988 | Speed | |
| 4,947,725 | A | | 8/1990 | Nomura | |
| 5,159,139 | A | | 10/1992 | Beals et al. | |
| 5,492,047 | A | | 2/1996 | Oliveri | |
| 5,864,077 | A | * | 1/1999 | Gatzen | 84/414 |

(Continued)

FOREIGN PATENT DOCUMENTS

| | | |
|---|---|---|
| JP | S64-54095 U | 4/1989 |
| JP | 3004768 U | 11/1994 |

(Continued)

OTHER PUBLICATIONS

Japanese Office Action dated Sep. 24, 2014 issued in corresponding Japanese Application JP 2012-201860 (partial English translation).

*Primary Examiner* — Robert W Horn
(74) *Attorney, Agent, or Firm* — Dickstein Shapiro LLP

(57) ABSTRACT

An acoustic drum 10 has a hollow cylindrical shell 11, a drumhead 12 mounted to an opening end of the shell 11 to form a striking surface, a striking surface attachment 13*a* provided on the entire surface of a useful movable portion of the front side of the drumhead 12, and a striking surface attachment 13*b* provided on the entire surface of a useful movable portion of the reverse side of the drumhead 12. Each of the striking surface attachments 13*a* and 13*b* is formed of a resin film, with respective outer areas of the striking surface attachments 13*a* and 13*b* being fixed to the drumhead 12. As a result, the acoustic drum 10 can reduce sound volume, while maintaining struck sounds having brightness and providing a player with favorable feeling of striking.

14 Claims, 13 Drawing Sheets

(56) References Cited

U.S. PATENT DOCUMENTS

| | | | | |
|---|---|---|---|---|
| 5,892,168 | A | 4/1999 | Donohoe | |
| 6,043,420 | A | 3/2000 | Arnold | |
| 6,245,979 | B1 | 6/2001 | Campbell | |
| 6,291,754 | B1 | 9/2001 | Gatzen et al. | |
| 6,297,177 | B1 * | 10/2001 | Belli et al. | 442/242 |
| 6,525,249 | B1 | 2/2003 | Suenaga | |
| 6,580,023 | B2 * | 6/2003 | Belli | 84/411 R |
| 6,686,526 | B2 * | 2/2004 | Ezbicki | 84/411 R |
| 6,784,352 | B2 | 8/2004 | Suenaga | |
| 6,927,330 | B2 | 8/2005 | May | |
| 6,949,701 | B2 * | 9/2005 | Okumura | 84/411 R |
| 7,074,994 | B2 | 7/2006 | Belli | |
| 7,214,867 | B1 | 5/2007 | Gatzen et al. | |
| D611,524 | S | 3/2010 | Lawrence, III | |
| 8,294,013 | B2 | 10/2012 | Lento | |
| 2002/0096035 | A1 * | 7/2002 | Good | 84/414 |
| 2003/0136244 | A1 | 7/2003 | Okumura | |
| 2004/0149120 | A1 | 8/2004 | Maruhashi et al. | |
| 2013/0042744 | A1 | 2/2013 | Hsien | |
| 2014/0060284 | A1 * | 3/2014 | Yoshino | 84/411 R |
| 2014/0069256 | A1 * | 3/2014 | Hashimoto | 84/414 |
| 2014/0069257 | A1 * | 3/2014 | Hashimoto | 84/414 |
| 2014/0144309 | A1 * | 5/2014 | Cawthorne | 84/411 R |

FOREIGN PATENT DOCUMENTS

| | | | |
|---|---|---|---|
| JP | H07-117830 | B2 | 12/1995 |
| JP | 2001-142459 | A | 5/2001 |
| JP | 2002-169537 | A | 6/2002 |
| JP | 3656633 | B2 | 6/2005 |

* cited by examiner (a)

(b)

(a)

(b)

ACOUSTIC DRUM

BACKGROUND OF THE INVENTION

1. Field of the Invention

The present invention relates to an acoustic drum which can reduce sound volume.

2. Description of the Related Art

Acoustic drums generate louder sounds than the other musical instruments. Therefore, there are conventional acoustic drums employing some method of reducing sound volume. For example, there is a conventional sound volume reduction method which provides gel or a sponge ring for vibration suppression on a part of a head member. However, this method is aimed at sound-absorbing and vibration suppression, and is disadvantageous in that a tonic pitch cannot maintain to fail to obtain natural sustain. Furthermore, because this method is a partial mute, a player might feel uncomfortable or cannot generate a sound if the player hits on the gel or the sponge ring.

Therefore, an acoustic drum which reduces sound volume by attaching a large vibration-absorbing member to a head member has been developed (for example, see Japanese Registered Utility Model No. 3004768). This drum is designed such that a drumhead is mounted on one opening end of a drum shell through a drum hoop while the drumhead is formed of two sheets of head members with a vibration-absorbing member formed of a thin rubber or plastic sheet being interposed to be attached between the two sheets of head members. This drum can achieve sufficient reduction in sound volume.

SUMMARY OF THE INVENTION

As for the above-described drum having the vibration-absorbing member, however, because the whole vibration-absorbing member is completely attached to the entire surface of the drumhead, loss of movability of the drumhead increases to result in sounds having no attack and harmonics. As a result, the sounds generated by the drum are muffled without brightness. Furthermore, as for the above-described drum having the vibration-absorbing member, it is also proposed that a plastic film is used as the vibration-absorbing member. In a case where the vibration-absorbing member made of a plastic film is fixed to the whole drumhead, however, the bending stiffness of the drumhead is high. Therefore, the drumhead behaves like a plate rather than a membrane, so that the reaction force increases. As a result, the player's hands hurt when the player hits on the drumhead. Due to the increased loss of movability of the drumhead, in addition, the rebound of a stick in response to a strike on the drumhead deteriorates.

The present invention was accomplished to solve the above-described problem, and an object thereof is to provide an acoustic drum that can reduce sound volume, while maintaining struck sounds having brightness and providing a player with favorable feeling of striking. As for descriptions for respective constituents of the present invention described below, numbers corresponding to components of later-described embodiments are given in parenthesis for easy understanding. However, the respective constituents of the present invention are not limited to the corresponding components indicated by the numbers of the embodiments.

In order to achieve the above-described object, it is a feature of the present invention to provide an acoustic drum (10, 20, 30, 40, 50, 60, 70, 80, 90, 100) including a hollow cylindrical shell (11, 21, 41, 51); a drumhead (12, 22, 62, 72, 82, 92, 102) mounted on one opening end of the shell to form a striking surface; and a striking surface attachment (13*a*, 13*b*, 23*a*, 23*b*, 63*a*, 63*b*, 73*a*, 73*b*, 83*a*, 83*b*, 93*a*, 93*b*, 103*a*, 103*b*) which is formed of a resin film to be placed on at least either a front side or a reverse side of the drumhead, wherein at least a part of an outer area of the striking surface attachment is fixed to the drumhead as a fixing potion without fixing a central area of the striking surface attachment to the drumhead.

In this case, for example, the striking surface attachment is placed over a surface of a movable part of at least a front side or a reverse side of the drumhead. It is preferable that the movable part is a useful movable part of at least a front side or a reverse side of the drumhead. The useful movable part is a portion which is a striking surface of the drumhead and excludes an invisible portion hidden by a hoop and the like. The central area of the striking surface attachment is an area close to the center of the striking surface attachment in a radial direction, while the outer area of the striking surface attachment is an area close to the outer rim of the striking surface attachment in the radial direction. The striking surface attachment can be made of a resin film such as PET (polyethylene terephthalate) or PEN (polyethylene naphthalate). Furthermore, it is preferable that the striking surface attachment is formed of the same material as a material of the drumhead. Furthermore, the striking surface attachment may be attached to the front side or the reverse side of the drumhead, or to the both sides. Furthermore, layers of the striking surface attachments may be attached to the front side or the reverse side, or to the both sides. Furthermore, the width of the fixing portion in a radial direction may fall within a range from 5 mm to 50% of a radius of the drumhead. In the present invention, furthermore, the fixing by which the striking surface attachment is fixed to the drumhead may be adhesion, bonding or fixing by use of a fixing member such as rivets or staples of stapler.

The acoustic drum according to the present invention is designed such that the striking surface attachment is provided on the drumhead with at least a part of the outer area of the striking surface attachment being fixed to the drumhead. As a result, the acoustic drum according to the present invention is designed to increase the mass of the drumhead by use of the striking surface attachment to reduce the amplitude of vibrations of a struck sound to efficiently reduce sound volume. In addition, a tonic pitch of the struck sound can sustain similarly to a conventional acoustic drum. Furthermore, because only the outer area of the striking surface attachment is fixed to the drumhead, the acoustic drum of the present invention can minimize the loss of the movability of the drumhead. Therefore, the acoustic drum according to the present invention can generate struck sounds having attack, also generating harmonic components which contribute brightness.

Furthermore, by fixing only at least a part of the outer area of the striking surface attachment to the drumhead, the acoustic drum according to the present invention can keep properties of drumhead serving as membrane. Therefore, the acoustic drum of the present invention can minimize deterioration of player's feeling of striking, also preventing from causing pain when a player strikes the acoustic drum. By fixing only at least a part of the outer area of the striking surface attachment to the drumhead, furthermore, the loss of movability of the drumhead can be minimized. Therefore, the acoustic drum according to the invention can keep favorable rebound of a stick, without hindering player's performance.

Furthermore, the fixing portion which is at least a part of the striking surface attachment may be a whole circumference of the outer area of the striking surface attachment.

Furthermore, the fixing portion may be formed of a plurality of parts situated on the outer area of the striking surface attachment to be away with each other with intervals being provided in a circumferential direction. Furthermore, the fixing portion may be formed of a plurality of parts scattered on the outer area of the striking surface attachment. However, it is preferable that a central portion which is hit with the stick is excluded from the fixing portion in order to prevent the striking surface attachment from producing ill effect on struck sounds. Without impairment of performance due to the striking surface attachment, as a result, the acoustic drum according to the present invention provides a player with sound quality and feeling of striking which are similar to the sound quality and the feeling provided by conventional acoustic drums.

Furthermore, the drumhead to which the striking surface attachment is attached and which is to be mounted on the shell may be replaceable. In this case, one of drumheads to which striking surface attachments each having a different fixing portion are attached, respectively, may be selectively attached to the shell. In other words, a plurality of assembled bodies each having a different fixing portion by which the striking surface attachment is fixed to the drumhead are prepared so that a player can choose a player's desired assembled body according to the player's purpose to mount the chosen body on the shell. Furthermore, the striking surface attachment which is to be attached to the drumhead may be replaceable. In this case, one of striking surface attachments each having a different fixing portion may be selectively fixed to the drumhead. In other words, by preparing different kinds of striking surface attachments having an adhesive agent or bonding adhesive on a different part which is to be fixed to the drumhead, the player can choose a player's desired striking surface attachment according to the player's purpose to fix the selected striking surface attachment to the drumhead. As a result, modes of use of the acoustic drum are widely broadened.

It is another feature of the acoustic drum according to the present invention that the acoustic drum further includes a resonance head (27, 37) mounted on the other opening end of the shell (21, 51). By providing the resonance head, the acoustic drum can generate a rich struck sound having many harmonic components.

It is still another feature of the acoustic drum according to the present invention that the acoustic drum further includes a non-striking surface attachment (33*a*, 33*b*) which is formed of a resin film to be placed on at least a front side or a reverse side of the resonance head (37), wherein at least a part of an outer area of the non-striking surface attachment is fixed to the resonance head as without fixing a central area of the non-striking surface attachment to the resonance head. In this case, for example, the non-striking surface attachment is placed over a surface of a movable part of at least either a front side or a reverse side of the resonance head. It is preferable that the movable part is a useful movable part of at least either a front side or a reverse side of the resonance head. Similarly to the above-described striking surface attachment, the at least a part of the outer area of the non-striking surface attachment fixed to the resonance head may be a whole circumference of the outer area of the non-striking surface attachment, or the fixing portion may be formed of a plurality of parts situated on the outer area of the non-striking surface attachment to be away with each other with intervals being provided in a circumferential direction. Furthermore, the fixing portion may be formed of a plurality of parts scattered on the outer area of the non-striking surface attachment. Compared with an acoustic drum having a resonance head without the non-striking surface attachment, the acoustic drum having this feature can increase the effect on reduction in sound volume. In this case as well, furthermore, the fixing by which the non-striking surface attachment is fixed to the resonance head may be adhesion, bonding or fixing by use of a fixing member such as rivets or staples of stapler.

Furthermore, the resonance head to which the non-striking surface attachment is attached and which is to be mounted on the shell may be replaceable. In this case, one of resonance heads to which non-striking surface attachments each having a different fixing portion are attached, respectively, may be selectively attached to the shell. In other words, a plurality of assembled bodies each having a different fixing portion by which the non-striking surface attachment is fixed to the resonance head are prepared so that a player can choose a player's desired assembled body according to the player's purpose to mount the chosen body on the shell. Furthermore, the non-striking surface attachment which is to be attached to the resonance head may be replaceable. In this case, one of non-striking surface attachments each having a different fixing portion may be selectively fixed to the resonance head. In other words, by preparing different kinds of non-striking surface attachments having an adhesive agent or bonding adhesive on a different part which is to be fixed to the resonance head, the player can choose a player's desired non-striking surface attachment according to the player's purpose to fix the selected non-striking surface attachment to the resonance head. As a result, modes of use of the acoustic drum are widely broadened.

It is a still further feature of the acoustic drum according to the present invention that the acoustic drum further includes a sound-absorbing member (42, 52) placed on a part of an inner surface of the shell (41, 51).

In a case where the drumhead is made heavier by attaching the striking surface attachment, the internal resonance of the shell tends to be reinforced. Although reinforced internal resonance could be inconvenient depending on the usage of an acoustic drum, the acoustic drum having this feature can reduce internal resonance generated inside the shell. By the sound-absorbing member placed on the inner surface of the shell, more specifically, the acoustic drum of the invention can reduce only the internal resonance generated inside the shell, without hindering vibrations of the drumhead.

In a case where the sound-absorbing member is placed at the center of the inner space of the shell, for instance, the sound-absorbing member hinders vibrations of the drumhead, or vibrations of the drumhead and the resonance head if the resonance head is also provided. As a result, an acoustic drum having such a sound-absorbing member cannot sustain a tonic pitch of a struck sound. By providing the sound-absorbing member on the inner peripheral surface of the shell, however, the acoustic drum according to the present invention can reduce internal resonance generated inside the shell without hindering basic vibrations of the drumhead, or the drumhead and the resonance head. As a result, the acoustic drum according to the present invention can generate comfortable struck sounds. As the sound-absorbing member, furthermore, urethane foam, sponge or the like can be used.

DESCRIPTION OF THE PREFERRED EMBODIMENT (First Embodiment)

Figure 1:
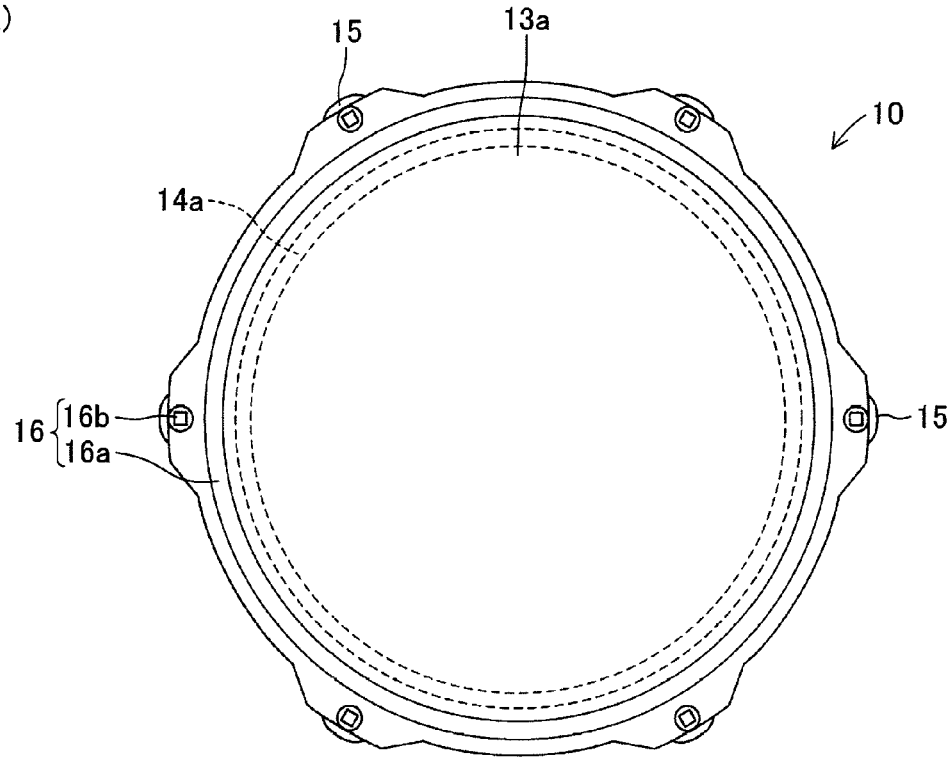
FIG. 1 shows an acoustic drum according to the first embodiment of the present invention, and more specifically, FIG. 1(*a*) is a top view, and FIG. 1(*b*) is a section view of the acoustic drum.
Figure 1:
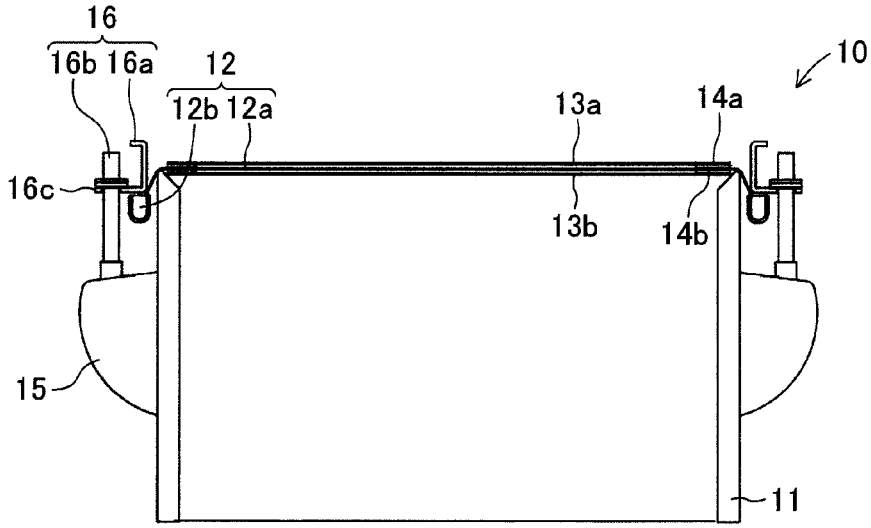

An acoustic drum according to the first embodiment of the present invention will now be described with reference to the drawings. FIGS. 1 (*a*) and (*b*) show an acoustic drum 10 according to the embodiment. In the following explanation on the acoustic drum 10, the vertical direction is defined as shown in FIG. 1(*b*). The acoustic drum 10 has a diameter of 12 inches with a depth of 11 inches. The acoustic drum 10 has a hollow cylindrical shell 11 which is a drum shell, and a circular drumhead 12 mounted on the upper opening end of the shell 11. To the front side and the reverse side of the drumhead 12, furthermore, striking surface attachments 13*a* and 13*b* (struck head mass-adding members 13*a* and 13*b*) are attached, respectively. Basically, the mass of the striking surface attachments 13*a* and 13*b* reduce volume of sounds generated by the acoustic drum 10 by suppressing vibrations of the drum head 12.

Figure 2:
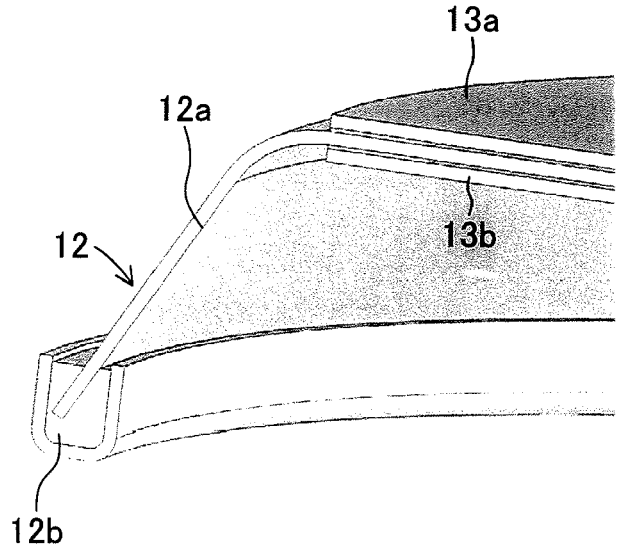
FIG. 2 is a partly notched perspective view indicative of a section of fixing portions by which striking surface attachments are fixed to a drumhead.

The shell 11 is made of wood (birch), and has functions of efficiently conveying internal air downward and resonating vibrations inside the shell 11 when vibrations occur. The drumhead 12 is formed of a circular head portion 12*a* made of a PET (polyethylene terephthalate) film and a flesh hoop 12*b* which is a metal ring. As indicated in FIG. 2, the head portion 12*a* is kept circular by connecting the outer edge of the head portion 12*a* with the flesh hoop 12*b*. The head portion 12*a* has a thickness of 250 μm, and has a diameter slightly larger than the diameter of the upper opening end of the shell 11.

Figure 3:
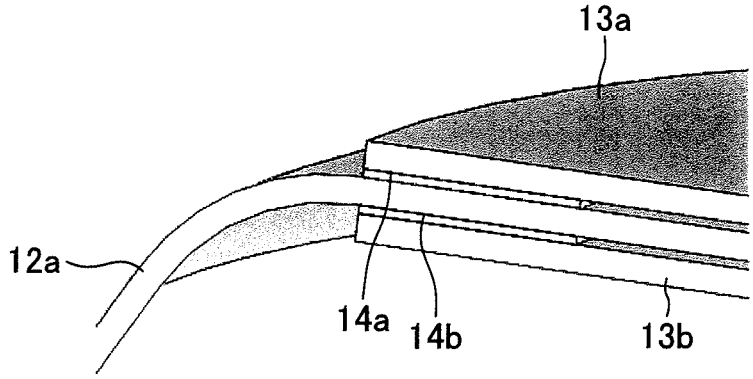
FIG. 3 is a partly notched perspective view indicative of a state where the striking surface attachments are fixed to the drumhead with double-faced tapes.

Each of the striking surface attachments 13*a* and 13*b* is formed of a circular PET film having a thickness of 250 μm and a diameter of 290 mm. In other words, the striking surface attachments 13*a* and 13*b* are formed of the film which are made of the same material as the head portion 12*a* but have the different diameter. As indicated in FIG. 3, furthermore, the striking surface attachment 13*a* is placed on the front side of the head portion 12*a*, with a whole outer area of the striking surface attachment 13*a* being fastened to the head portion 12*a* by a double-faced tape 14*a* formed of acrylic pressure-sensitive adhesive and non-woven fabric.

The striking surface attachment 13*b* is placed on the reverse side of the head portion 12*a*, with a whole outer area of the striking surface attachment 13*b* being fastened to the head portion 12*a* by a double-faced tape 14*b*. The width for which the striking surface attachments 13*a* and 13*b* are fixed to the head portion 12*a* (the width of the double-faced tapes 14*a* and 14*b*) is 10 mm. The striking surface attachments 13*a* and 13*b* range all over respective later-described useful movable parts of the front side and the reverse side of the head portion 12*a*. Respective central areas of the striking surface attachments 13*a* and 13*b* are not fixed to the front side and the reverse side of the head portion 12*a*. The central area of each of the striking surface attachments 13*a* and 13*b* indicates an area which is close to the center in a radial direction of the striking surface attachments 13*a* and 13*b*, while the outer area of each of the striking surface attachments 13*a* and 13*b* indicates an area which is close to the outer rim in the radial direction of the striking surface attachments 13*a* and 13*b*.

The drumhead 12 to which the striking surface attachments 13*a* and 13*b* are attached is mounted on the upper opening end of the shell 11 by lugs 15 and a stretching portion 16 so that the drumhead 12 can be detached. The drumhead 12 is formed to have a part where the head portion 12*a* and the striking surface attachments 13*a* and 13*b* overlap each other to form a striking surface (a struck head) which a player hits. The internal diameter of the flesh hoop 12*b* is slightly larger than the outer diameter of the shell 11, so that when the upper portion of the shell 11 is placed within the flesh hoop 12*b*, the outer area of the head portion 12*a* and the outer edge of the striking surface attachment 13*b* are pressed against the upper edge of the shell 11. The striking surface attachments 13*a* and 13*b* are situated at a part corresponding to the upper opening end of the shell 11, while the part situated on the head portion 12*a* corresponding to the upper opening end of the shell 11 is the useful movable part according to the present invention.

Each lug 15 is a member which gradually tapers from the flat top surface to the bottom, and has a screw hole internally extending from the top surface toward the bottom in parallel to the outer peripheral surface of the shell 11. The inner surface of the lugs 15 is curved along the outer peripheral surface of the shell 11, so that the lugs 15 are fastened along the outer peripheral surface of the shell 11 to be situated at the center in the vertical direction of the outer peripheral surface of the shell 11. There are six lugs 15 provided along the periphery of the shell 11 at regular intervals.

The stretching portion 16 is formed of a hoop 16*a* and tuning bolts 16*b*. The hoop 16*a* is a ring whose cross section is shaped like the letter U which is open outward. The hoop 16*a* has an internal diameter and an outer diameter which are approximately the same as those of the flesh hoop 12*b*. From the lower end of the outer rim of the hoop 16*a*, furthermore, engaging projections 16*c* each having a bolt-inserting hole protrude outward. As many engaging projections 16*c* as the lugs 15 are provided around the hoop 16*a* at regular intervals. Each tuning bolt 16*b* is formed of a thread portion which can be inserted into the bolt-inserting hole of the engaging projection 16*c* and can be engaged in the screw hole of the lug 15, and a head portion whose diameter is larger than the diameter of the bolt-inserting hole of the engaging projection 16*c* so that the head portion cannot be inserted in the bolt-inserting hole of the engaging projection 16*c*. Therefore, there are as many tuning bolts 16*b* as the lugs 15.

Therefore, the drumhead 12 can be fixed to the shell 11 by mounting the drumhead 12 to which the striking surface attachments 13*a* and 13*b* are attached on the upper opening end of the shell 11, with the hoop 16*a* being aligned with the upper part of the flesh hoop 12*b* to insert the thread portions of the respective tuning bolts 16*b* into the bolt-inserting holes of the engaging projections 16*c* to engage the thread portions in the screw holes of the lugs 15 in a state where the engaging projections 16*c* face the lugs 15, respectively. By adjusting the tightness of the tuning bolts 16*b*, the tension of the drumhead 12 and the striking surface attachments 13*a* and 13*b* can be adjusted. In this case, the upper portion of the hoop 16*a* protrudes above the drumhead 12 so that a player can hit the upper portion with a shoulder portion of a stick S (see FIGS. 4(*a*) and (*b*)).

When the drumhead 12 (strictly speaking, the striking surface attachment 13*a*, and ditto for description on the striking surface of the acoustic drum 10) of the acoustic drum 10 configured as above is hit with the stick S, the drumhead 12 is displaced along with the striking surface attachments 13*a* and 13*b*. In this case, the drumhead 12 and the striking surface attachments 13*a* and 13*b* vibrate as a single unit as a whole. However, tension is exerted individually on the drumhead 12 and the striking surface attachments 13*a* and 13*b*, so that the drumhead 12 and the striking surface attachments 13*a* and 13*b* separately behave locally and instantly as separate membranes. By the displacement of the drumhead 12 and the striking surface attachments 13*a* and 13*b*, furthermore, the air within the shell 11 is compressed to move downward. Then, the deformation of the drumhead 12 and the striking surface attachments 13*a* and 13*b* is repeated to result in vibrations, so that vibrations of air produced by the vibrations resonate as a struck sound.

Figure 4:
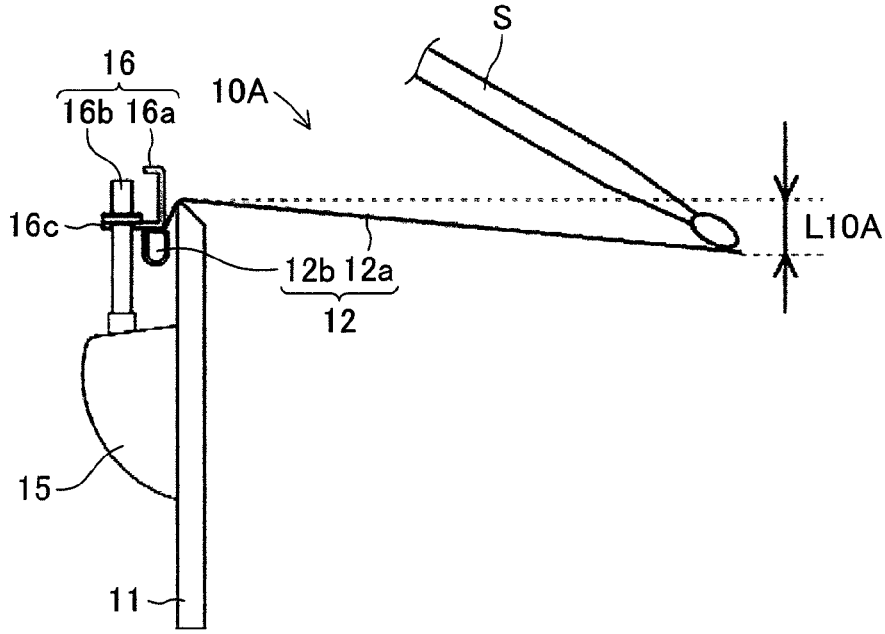
FIG. 4 is illustrations for explaining an effect on reduction in sound volume, and more specifically, FIG. 4(*a*) is an illustration of a conventional acoustic drum, and FIG. 4(*b*) is an illustration of the acoustic drum of the first embodiment.
Figure 4:
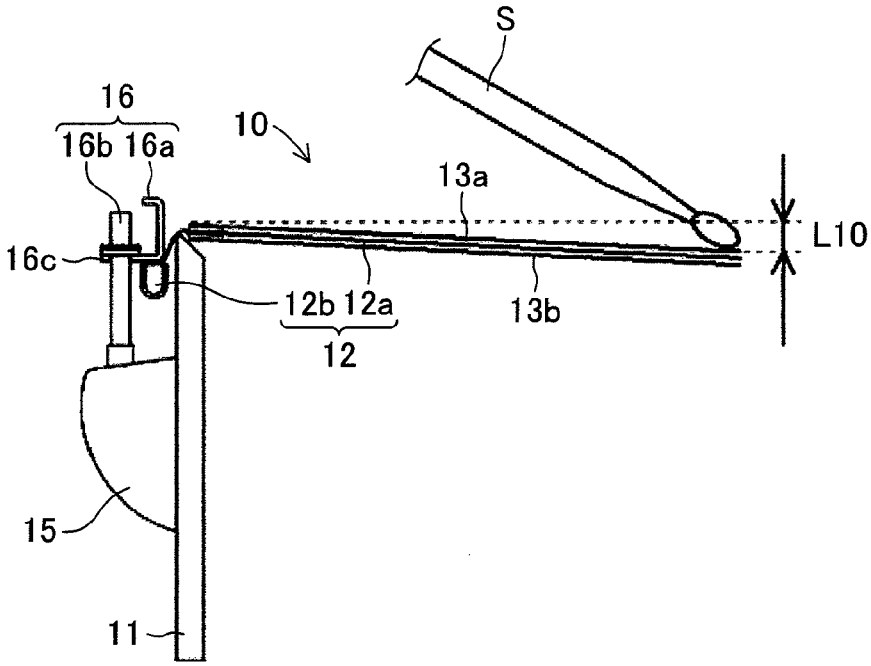

Because of the existence of the striking surface attachments 13*a* and 13*b*, the acoustic drum 10 can reduce the sound volume of sounds generated by player's performance, compared to a conventional acoustic drum. The effect on reduction in sound volume in comparison between the acoustic drum 10 and the conventional acoustic drum will be explained with reference to FIGS. 4(*a*) and (*b*). FIG. 4(*a*) indicates a state where a conventional acoustic drum 10A was hit with the stick S, while FIG. 4(*b*) indicates a state where the acoustic drum 10 was hit with the stick S. Except the absence of the striking surface attachments 13*a* and 13*b*, the acoustic drum 10A is configured similarly to the acoustic drum 10. In FIG. 4(*a*), therefore, parts similar to those of the acoustic drum 10 are given numerals similar to those given in FIG. 4(*b*).

In response to a player's strike on the drumhead 12 with the stick S, the drumhead 12 of the acoustic drum 10A and the acoustic drum 10 is displaced and vibrates. The sound volume of the struck sound generated by the strike is largely influenced by the maximum displacement of the drumhead 12. In the case of the acoustic drum 10A, as indicated in FIG. 4(*a*), in response to a player's strike on the drumhead 12 (the head portion 12*a*) with the stick S, the maximum displacement of the drumhead 12 (the head portion 12*a*) is L10A. In the case of the acoustic drum 10, as indicated in FIG. 4(*b*), in response to a player's strike on the top surface of the striking surface attachment 13*a* with the stick S, the maximum displacement of the drumhead 12 (the head portion 12*a*) to which the striking surface attachments 13*a* and 13*b* are attached is L10 which is smaller than the maximum displacement L10A of the acoustic drum 10A.

Because of the existence of the striking surface attachments 13*a* and 13*b*, the acoustic drum 10 has the useful movable part which is three times heavier than that of the acoustic drum 10A. In coordination with the increased weight of the useful movable part of the acoustic drum 10, the maximum displacement of the drumhead 12 (the head portion 12*a*) of the acoustic drum 10 largely decreases. As a result, the sound volume of the acoustic drum 10 is reduced. In this case, the acoustic drum 10 can reduce only the sound volume, maintaining the timbre that is similar to the timbre of the acoustic drum 10A.

Figure 5:
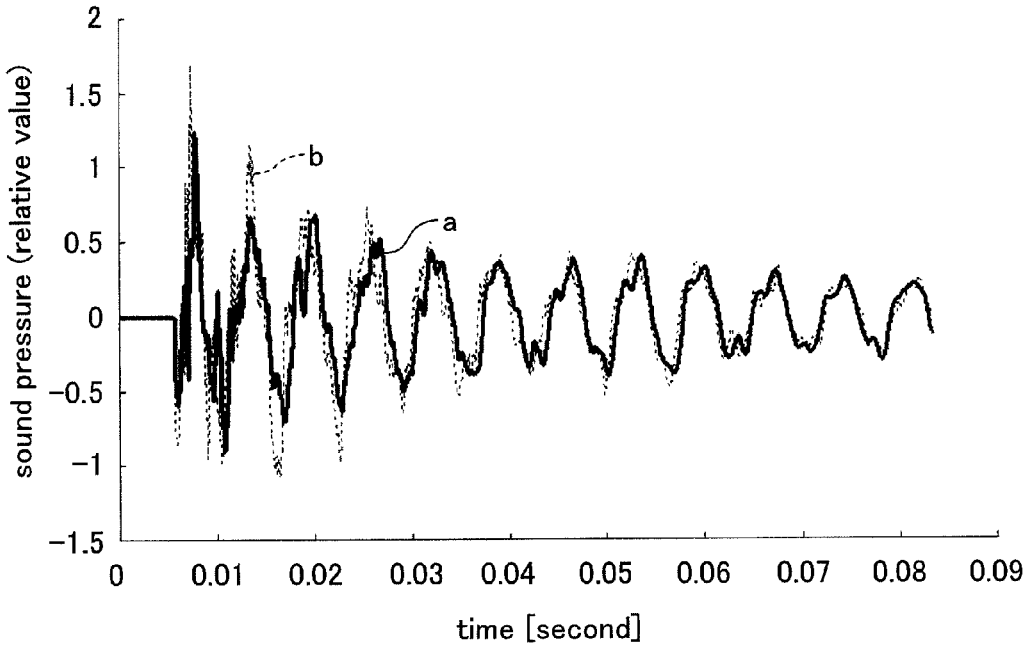
FIG. 5 is a graph comparing the magnitude of sound pressure of respective struck sounds of the conventional acoustic drum and the acoustic drum of the first embodiment with respect to elapsed time from a strike.

Next, an experiment in which a struck sound of the acoustic drum 10A and a struck sound of the acoustic drum 10 are concretely measured and compared with each other was carried out. As for the striking of the drums, an identical player struck the respective acoustic drums by use of the identical stick S to play the drums moderately loud (mezzo forte). By a microphone for measurement placed near the drumhead 12, the struck sounds were collected to analyze the sounds. FIG. 5 indicates resultant waveforms representative of changes in sound pressure of the respective struck sounds of the acoustic drum 10 and the acoustic drum 10A with respect to elapsed time.

In FIG. 5, a solid line "a" indicates the waveform of the struck sound of the acoustic drum 10, while a broken line "b" indicates the waveform of the struck sound of the acoustic drum 10A. As apparent from FIG. 5, the maximum amplitude of the solid line "a" in response to the strike is smaller than the maximum amplitude of the broken line "b". This is brought about by the effect on the mass of the striking surface attachments 13*a* and 13*b*. In other words, it is obvious that the acoustic drum 10 can reduce the maximum amplitude of the drumhead 12 in response to the strike.

As for the other part of the waveforms, the solid line "a" and the broken line "b" are approximately similar with each other, resulting in no difference between the struck sound of the acoustic drum 10A and the struck sound of the acoustic drum 10. On the struck sound of the acoustic drum 10, more specifically, attack and harmonics are generated at the initial phase of the strike similarly to the acoustic drum 10A. Similarly to the acoustic drum 10A, furthermore, the struck sound of the acoustic drum 10 maintains pitches necessary for tom-toms and floor toms which are acoustic drums.

In addition, an experiment in which an acoustic drum employing a conventional sound volume reduction method was added as a comparison example to the above-described acoustic drum 10 and the acoustic drum 10A to compare their respective struck sounds was carried out. The acoustic drum of the comparison example is obtained by attaching PET films which are identical with the striking surface attachments 13*a* and 13*b* to the front side and the reverse side of a drumhead of an acoustic drum which is identical with the above-described acoustic drum 10A, with the entire PET films being completely fastened to the front side and the reverse side of the drumhead by use of acrylic pressure-sensitive adhesive layer which is identical with the double-faced tapes 14*a* and 14*b*. In other words, the acoustic drum of the comparison example is identical with the acoustic drum 10 if the entire surface of each of the striking surface attachments 13*a* and 13*b* were fastened to the drumhead 12. More specifically, the acoustic drum of the comparison example is equivalent to the drum described in Description of the Related Art.

Figure 6:
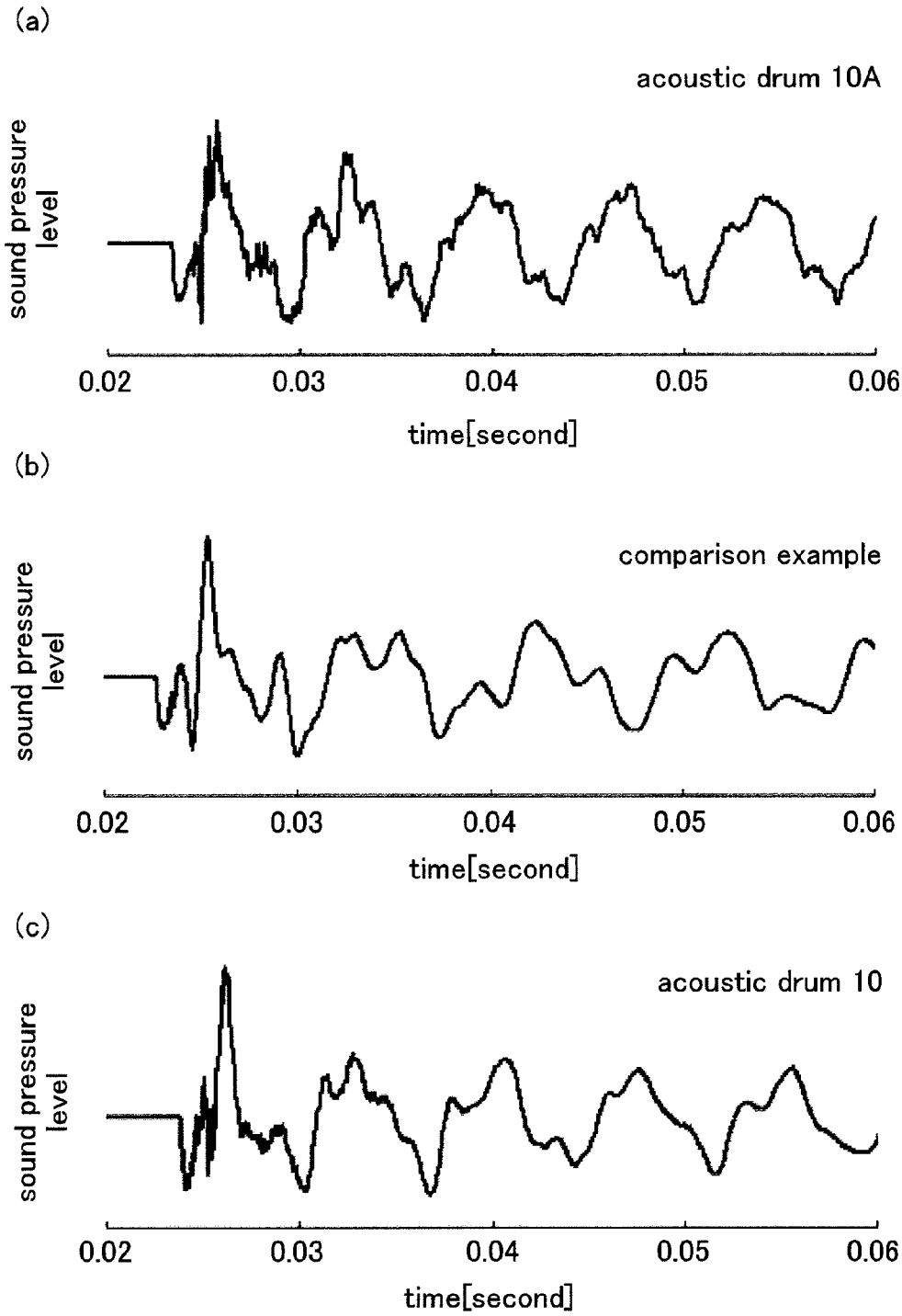
FIG. 6 indicates graphs representative of the magnitude of sound pressure with respect to elapsed time from a strike, and more specifically, FIG. 6(*a*) shows a waveform representative of a struck sound of the conventional acoustic drum, FIG. 6(*b*) shows a waveform representative of a struck sound of an acoustic drum of a comparison example, and FIG. 6(*c*) shows a waveform representative of a struck sound of the acoustic drum of the first embodiment.

In this experiment, the drums were struck with an arm having the mass equivalent to the stick S at an initial velocity (6.3 m/s) equivalent to mezzo forte in consideration of reproducibility. In other words, without torque equivalent to player's muscles, the drums were struck by a machine on the basis only of the initial velocity and the mass. Furthermore, by a microphone for measurement placed near the drumhead 12, struck sounds were collected to analyze the sounds on the basis of time and frequencies. In addition, the force of the top end of the arm and the movements (incident velocity and reflection velocity) of the top end of the arm were also measured in this experiment. Results of the time analysis are shown in FIGS. 6(*a*) to (*c*). FIGS. 6(*a*) to (*c*) indicate waveforms representative of changes in the magnitude of the respective struck sounds with respect to time elapsed from the respective strikes of the drums. More specifically, FIG. 6(*a*) indicates a waveform of the struck sound of the acoustic drum 10A, FIG. 6(*b*) indicates a waveform of the struck sound of the acoustic drum of the comparison example, and FIG. 6(*c*) indicates a waveform of the struck sound of the acoustic drum 10.

The resultant waveforms of FIGS. 6(*a*) to (*c*) have approximately the same shape as a whole, which reveals that respective tonic pitches (respective pitches) sustain roughly equally. However, because the waveform of the acoustic drum of the comparison example indicated in FIG. 6(*b*) hardly has initial harmonic components, the struck sound of the acoustic drum of the comparison example has no attack to result in a muffled sound. The absence of harmonic components can be judged because the first peak of the waveform shown in FIG. 6(*b*) hardly has small vertical serrations exhibited in FIGS. 6(*a*) and (*c*). Such a muffled sound having no attack makes it difficult to provide beat and to beat out a rhythm, resulting in degraded performance.

Furthermore, differences between the acoustic drum 10A and acoustic drum 10, and the acoustic drum of the comparison example are not only the initial attack but also harmonic components contained in a sustained tonic pitch. When comparisons are made between respective right parts of the waveforms shown in FIGS. 6(*a*) to (*c*), the waveforms shown in FIGS. 6(*a*) and (*c*) are sharper than the waveform shown in FIG. 6(*b*). Therefore, this experiment reveals that the acoustic drum 10A and the acoustic drum 10 generate a struck sound having a tonic pitch containing more harmonic components than the acoustic drum of the comparison example, so that the acoustic drum 10A and the acoustic drum 10 can generate sounds having bright timbre.

Figure 7:
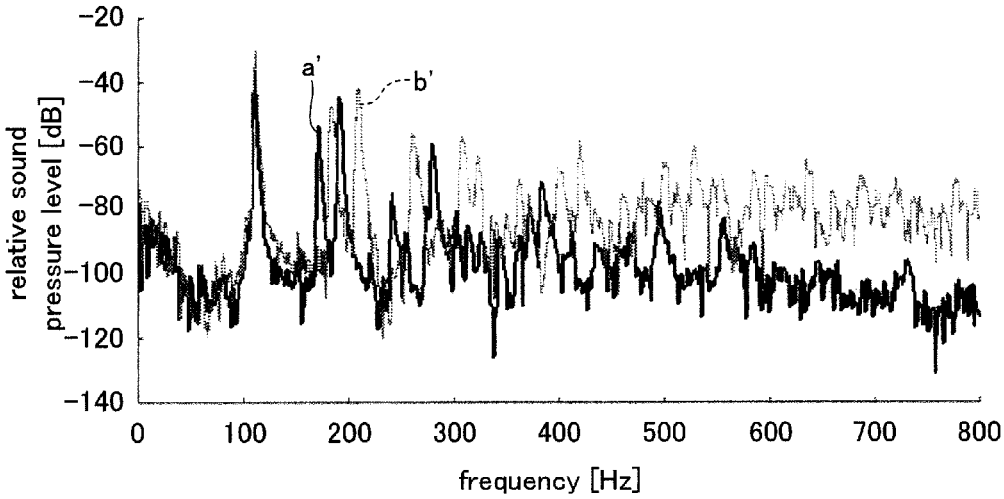
FIG. 7 is a graph comparing the magnitude of sound pressure of struck sounds of the conventional acoustic drum and the acoustic drum of the first embodiment with respect to frequency.
Figure 8:
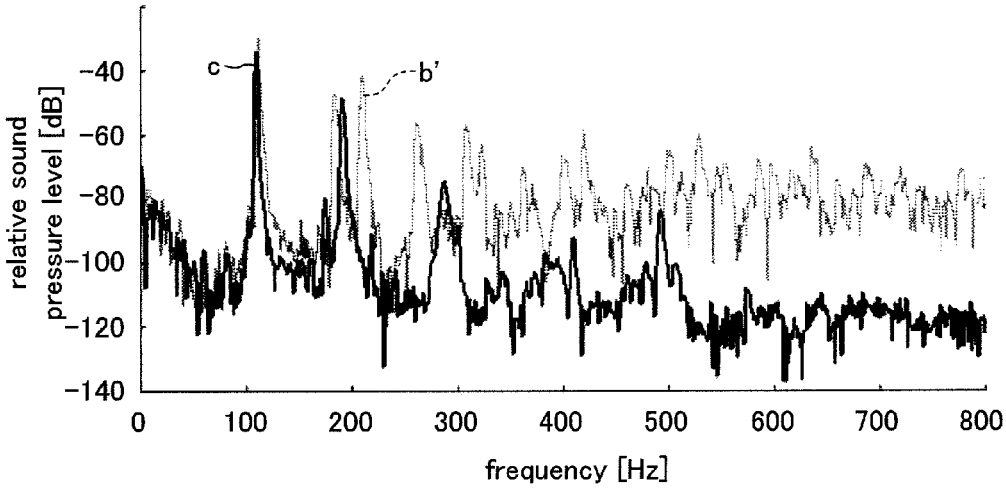
FIG. 8 is a graph comparing the magnitude of sound pressure of struck sounds of the conventional acoustic drum and the acoustic drum of the comparison example with respect to frequency.

FIG. 7 indicates results of observation in frequency domain of the struck sounds of the acoustic drum 10A and the acoustic drum 10, while FIG. 8 indicates results of observation in frequency domain of the struck sounds of the acoustic drum 10A and the acoustic drum of the comparison example. In FIG. 7, a solid line "a'" represents the struck sound of the acoustic drum 10, while a broken line "b'" represents the struck sound of the acoustic drum 10A. In FIG. 8, a solid line "c" represents the struck sound of the acoustic drum of the comparison example, while a broken line "b'" represents the struck sound of the acoustic drum 10A. Both the broken line "b'" of FIG. 7 and the broken line "b'" of FIG. 8 represent an identical waveform.

The experiment reveals that although FIG. 7 indicates that there are no significant differences between the solid line "a'" and the broken line "b'" in a range of the order of 150 Hz to 400 Hz, FIG. 8 indicates that harmonic components significantly decreases on the solid line "c", compared with the broken line "b'" in the range of the order of 150 Hz to 400 Hz. Therefore, it can be understood that the acoustic drum 10 can generate a struck sound which is rich in harmonic components of a tonic pitch, compared with the acoustic drum of the comparison example. On the right part of the waveforms shown in FIG. 7, furthermore, there are no significant differences between the solid line "a'" and the broken line "b'". On the right part of the waveforms shown in FIG. 8, however, harmonic components abruptly decrease at the frequencies exceeding 500 Hz on the solid line "c", compared with the broken line "b'". Therefore, it can be understood that the acoustic drum 10 can generate a struck sound also having plenty of harmonic components that bring about attack, compared with the acoustic drum of the comparison example.

Figure 9:
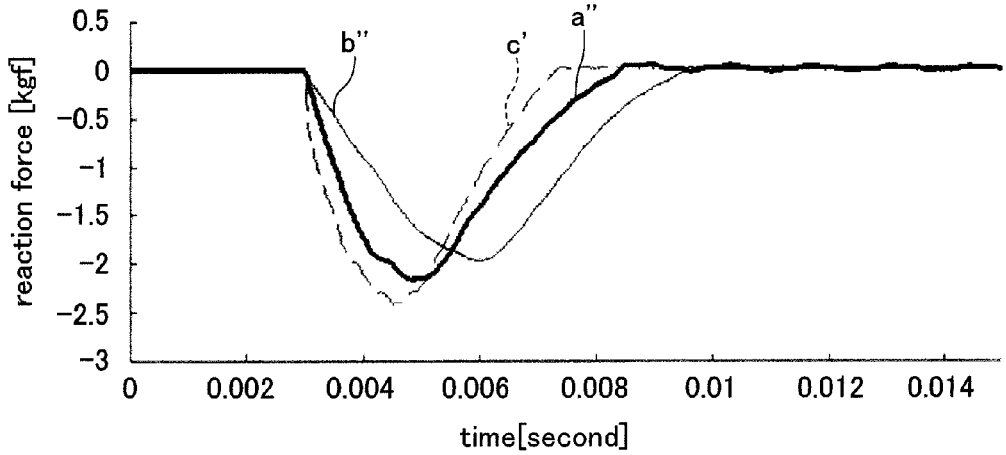
FIG. 9 is a graph indicating time-varying reaction force produced in response to a strike on the acoustic drum of the first embodiment, the conventional acoustic drum and the acoustic drum of the comparison example.

Next, the reaction force exerted on the arm when the arm hit the drum was measured. The results are shown in FIG. 9. FIG. 9 represents the magnitude of the reaction force exerted when the arm hit the drumhead with respect to elapsed time. In waveforms shown in this graph, recessed portions in which the reaction force is smaller than or equal to 0 kgf indicate a time period in which the arm is in contact with the drumhead. In FIG. 9, furthermore, a solid line "a'" represents the waveform of the struck sound of the acoustic drum 10, a solid line "b'" represents the waveform of the struck sound of the acoustic drum 10A, and a broken line "c'" represents the waveform of the struck sound of the acoustic drum of the comparison example. As apparent from FIG. 9, the time period in which the arm is in contact with the drumhead increases in the order of the broken line "c'", the solid line "a'", the solid line "b'", while the maximum value of the reaction force decreases in the order of the broken line "C'", the solid line "a'", the solid line "b'".

When the player strikes the drumhead with the stick S, the shorter the time period during which the stick S is in contact with the drumhead is, the stronger the player's pain is. Furthermore, the larger the maximum value of the reaction force is, the stronger the player's pain is. For a strike on the drumhead with a certain level of strength, therefore, the acoustic drum of the comparison example causes the strongest pain, while the acoustic drum 10A causes the smallest pain. The pain caused by the acoustic drum 10 is intermediate between the acoustic drum of the comparison example and the acoustic drum 10A.

As described above, in the case of the acoustic drum of the comparison example whose PET films are entirely fixed to the drumhead, the drumhead vibrates as a thick plate as a whole, so that the drumhead of the acoustic drum of the comparison example has quite high bending stiffness to tend to cause strong pain when the player strikes the drumhead. In the case of the acoustic drum 10, however, because only the respective outer areas of the striking surface attachments 13*a* and 13*b* are fastened to the drumhead 12, the drumhead 12 and the striking surface attachments 13*a* and 13*b* vibrate as membranes. Therefore, the bending stiffness of the drumhead 12 of the acoustic drum 10 is not high, so that the pain felt by the player when he strikes the drumhead is close to the pain felt when the player plays the acoustic drum 10A.

Figure 10:
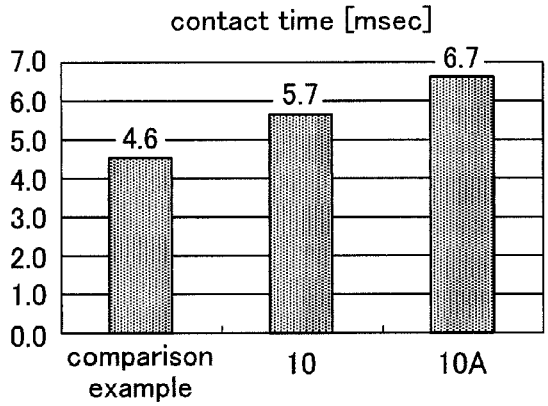
FIG. 10 is a graph indicating a time period during which an arm is in contact with the drumhead when the arm strikes the drumhead of the acoustic drum of the first embodiment, the conventional acoustic drum and the acoustic drum of the comparison example.
Figure 11:
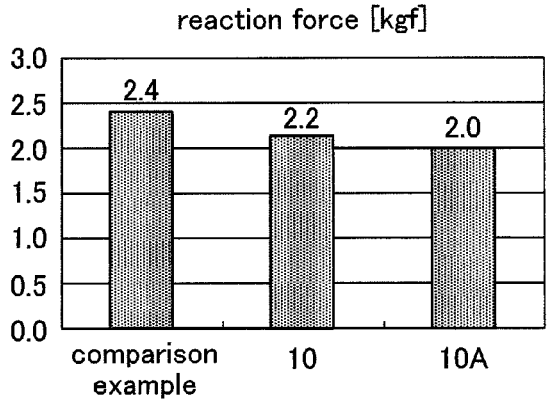
FIG. 11 is a graph indicating the magnitude of reaction force exerted at the time of a strike on the acoustic drum of the first embodiment, the conventional acoustic drum and the acoustic drum of the comparison example.

Based on the results shown in FIG. 9, FIG. 10 indicates respective time periods during which the arm is in contact with the drumhead when the respective drums are struck, while FIG. 11 indicates respective maximum values of the reaction force. As indicated in FIG. 10, the contact time of the acoustic drum of the comparison example is 4.6 ms, the contact time of the acoustic drum 10 is 5.7 ms, and the contact time of the acoustic drum 10A is 6.7 ms. As indicated in FIG. 11, furthermore, the maximum value of the reaction force of the acoustic drum of the comparison example is 2.4 kgf, the maximum value of the reaction force of the acoustic drum 10 is 2.2 kgf, and the maximum value of the reaction force of the acoustic drum 10A is 2.0 kgf.

Figure 12:
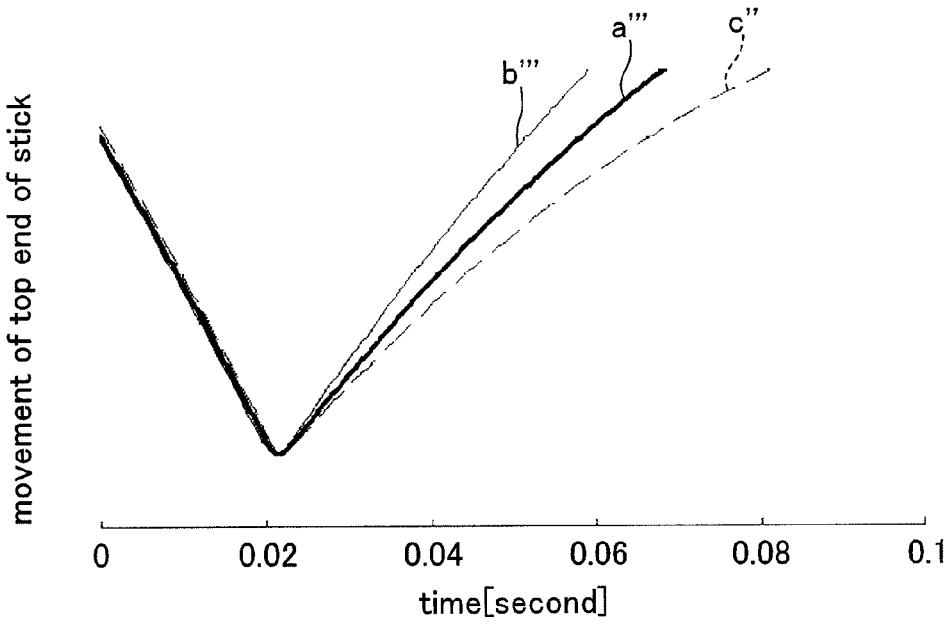
FIG. 12 is a graph indicating the movement of a stick observed at the time of a strike on the acoustic drum of the first embodiment, the conventional acoustic drum and the acoustic drum of the comparison example.
Figure 13:
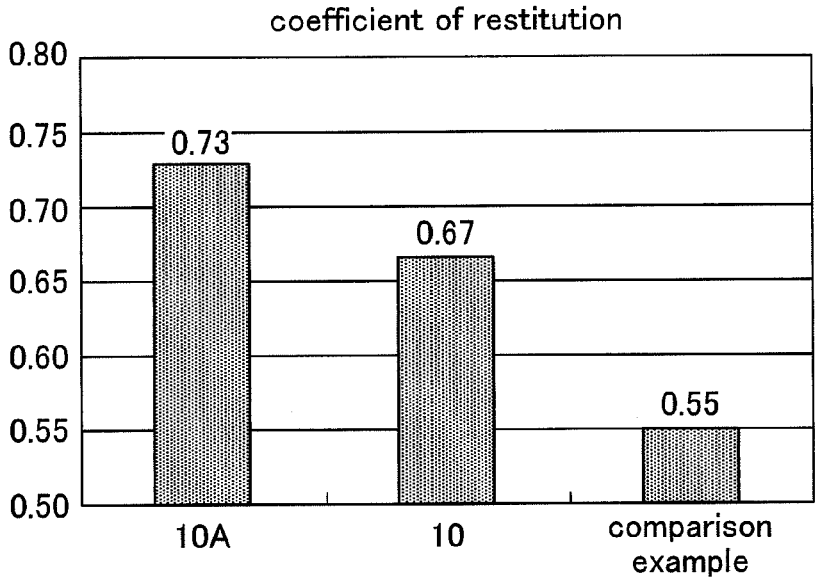
FIG. 13 is a graph indicating coefficient of restitution of the acoustic drum of the first embodiment, the conventional acoustic drum and the acoustic drum of the comparison example.

Next, the movement of the top end of the arm (stick S) at the time of a strike was observed. FIG. 12 indicates the observed results. FIG. 12 indicates the movement of the arm end at the time of a strike of the drumhead with the arm with respect to elapsed time. From the observed movement, the magnitude of restitution felt by the player can be read. In FIG. 12, a solid line "a'" represents the arm's movement observed when the acoustic drum 10 was struck, a solid line "b'" represents the arm's movement observed when the acoustic drum 10A was struck, and a broken line "c'" represents the arm's movement observed when the acoustic drum of the comparison example was struck. FIG. 13 indicates the ratio between incident velocity and reflection velocity as coefficient of restitution based on the time waveforms shown in FIG. 12.

As indicated in FIG. 13, the coefficient of restitution for the strike on the acoustic drum 10A is 0.73, the coefficient of restitution for the strike on the acoustic drum 10 is 0.67, and the coefficient of restitution for the strike on the acoustic drum of the comparison example is 0.55. The coefficient of restitution is very important in terms of player's playability. Furthermore, it is preferable to exhibit restitution similar to the restitution of the conventionally used acoustic drum 10. As apparent from FIG. 13, therefore, the acoustic drum 10 exhibits the restitution which is close to the restitution of the acoustic drum 10A. Therefore, although the restitution of the acoustic drum 10 is favorable, the restitution of the acoustic drum of the comparison example is not so favorable.

As described above, in the case of the acoustic drum of the comparison example whose PET films are entirely fastened to the drumhead, the drumhead vibrates like a plate having a great loss of movability. Therefore, the drumhead of the acoustic drum of the comparison example suffers a great loss when the drumhead is struck, resulting in the unfavorable rebound of the stick S. In the case of the acoustic drum 10, however, because the striking surface attachments 13*a* and 13*b* are fastened to the drumhead by use of the minimum area of the striking surface attachments 13*a* and 13*b*, the drumhead 12 and the striking surface attachments 13*a* and 13*b* vibrate as multi-ply membranes having a small loss of movability to result in a small loss caused by the strike. Therefore, the acoustic drum 10 has the restitution which is close to that of the acoustic drum 10A.

As described above, the acoustic drum 10 according to the embodiment is designed such that the striking surface attachments 13*a* and 13*b* are placed on the front side and the reverse side of the drumhead 12, respectively, with the outer areas of the striking surface attachments 13*a* and 13*b* being fastened to the drumhead 12. By making the drumhead 12 heavy by use of the striking surface attachments 13*a* and 13*b* to reduce the amplitude of the vibrations of a struck sound, the sound volume is efficiently reduced on the acoustic drum 10.

Furthermore, because only the respective outer areas of the striking surface attachments 13*a* and 13*b* are fixed to the drumhead 12, the drumhead 12 and the striking surface attachments 13*a* and 13*b* vibrate as a single unit as a whole in response to a strike on the acoustic drum 10, but separately behave locally and instantly. Such behaviors maintain a struck sound having clear attack. Furthermore, because the respective central areas which are to be hit with the stick S on the striking surface attachments 13*a* and 13*b* are not fixed to the drumhead 12, the striking surface attachments 13*a* and 13*b* never cause ill effect on struck sounds. As a result, the acoustic drum 10 can provide a player with sound quality and feeling of striking which are similar to the sound quality and the feeling provided by conventional acoustic drums. Therefore, the acoustic drum 10 does not impair playability in spite of the existence of the striking surface attachments 13*a* and 13*b*.

(Second Embodiment)

Figure 14:
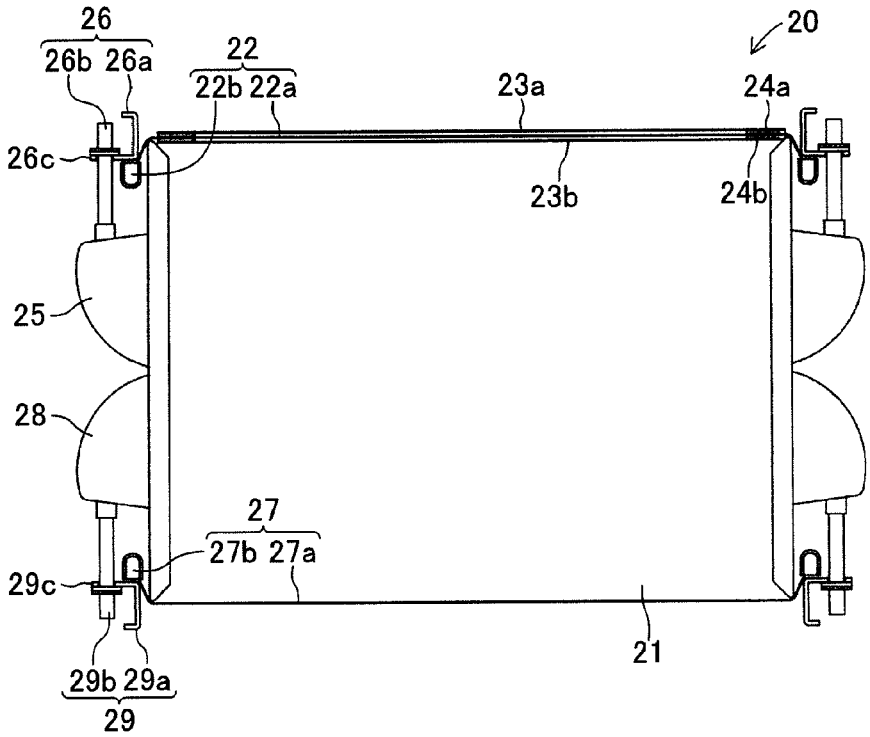
FIG. 14 is a section view of an acoustic drum according to the second embodiment of the present invention.

FIG. 14 shows an acoustic drum 20 according to the second embodiment of the present invention. The acoustic drum 20 has a hollow cylindrical shell 21 which is a drum shell, a circular drumhead 22 mounted on the upper opening end of the shell 21, and a circular resonance head 27 mounted on the lower opening end of the shell 21. The drumhead 22 is formed of a head portion 22*a* and a flesh hoop 22*b*. To the front side and the reverse side of the head portion 22*a*, striking surface attachments 23*a* and 23*b* are attached with double-faced tapes 24*a* and 24*b*. The drumhead 22 is mounted on the upper opening end of the shell 21 by six lugs 25 provided on the outer peripheral surface of the shell 21 and a stretching portion 26 formed of a hoop 26*a* including engaging projections 26*c* and tuning bolts 26*b*. The lugs 25 are placed such that the lower end of each lug 25 is situated slightly above the vertical center of the shell 21.

Among the above-described members, the shell 21, the drumhead 22, the striking surface attachments 23*a* and 23*b*, the double-faced tapes 24*a* and 24*b*, the lugs 25 and the stretching portion 26 are configured similarly to the shell 11, the drumhead 12, the striking surface attachments 13*a* and 13*b*, the double-faced tapes 14*a* and 14*b*, the lugs 15 and the stretching portion 16 of the above-described first embodiment. In other words, the acoustic drum 20 is identical with the acoustic drum 10 if the resonance head 27 were excluded from the acoustic drum 20, with the lugs 25 being moved upward.

The resonance head 27 is formed of a circular head portion 27*a* made of the same PET film as the head portion 22*a* and a flesh hoop 27*b* which is the same metal ring as the flesh hoop 22*b*. The resonance head 27 is mounted on the lower opening end of the shell 21 through six lugs 28 and a stretching portion 29 provided to be vertically symmetrical with the lugs 25 and the stretching portion 26 so that the resonance head 27 can be attached/detached to/from the lower opening end of the shell 21 by a manner similar to the drumhead 22 though the direction is switched upside down. In this case as well, respective thread portions of respective tuning bolts 29*b* provided on the stretching portion 29 are inserted into bolt-inserting holes of engaging projections 29*c* provided on the hoop 29*a* to engage the thread portions in respective screw holes of the lugs 28. By adjusting the tightness of the tuning bolts 29*b*, the tension of the resonance head 27 can be adjusted.

When the striking surface of the acoustic drum 20 configured as above is hit with the stick S, the drumhead 22 is displaced along with the striking surface attachments 23*a* and 23*b*. In this case, the drumhead 22 and the striking surface attachments 23*a* and 23*b* vibrate similarly to the above-described drumhead 12 and the striking surface attachments 13*a* and 13*b*. By the displacement of the drumhead 22 and the striking surface attachments 23*a* and 23*b*, furthermore, the air within the shell 21 is compressed, so that the compressed air presses the resonance head 27 downward to deform the resonance head 27.

Then, the deformation of the drumhead 22, the striking surface attachments 23*a* and 23*b*, and the resonance head 27 is repeated to result in vibrations, so that vibrations of air produced by the vibrations resonate as a struck sound. The resultant struck sound is a rich sound having more harmonic overtones than the struck sound generated by the acoustic drum 10. The operational advantage of the acoustic drum 20 other than the above is the same as that of the acoustic drum 10.

(Third Embodiment)

Figure 15:
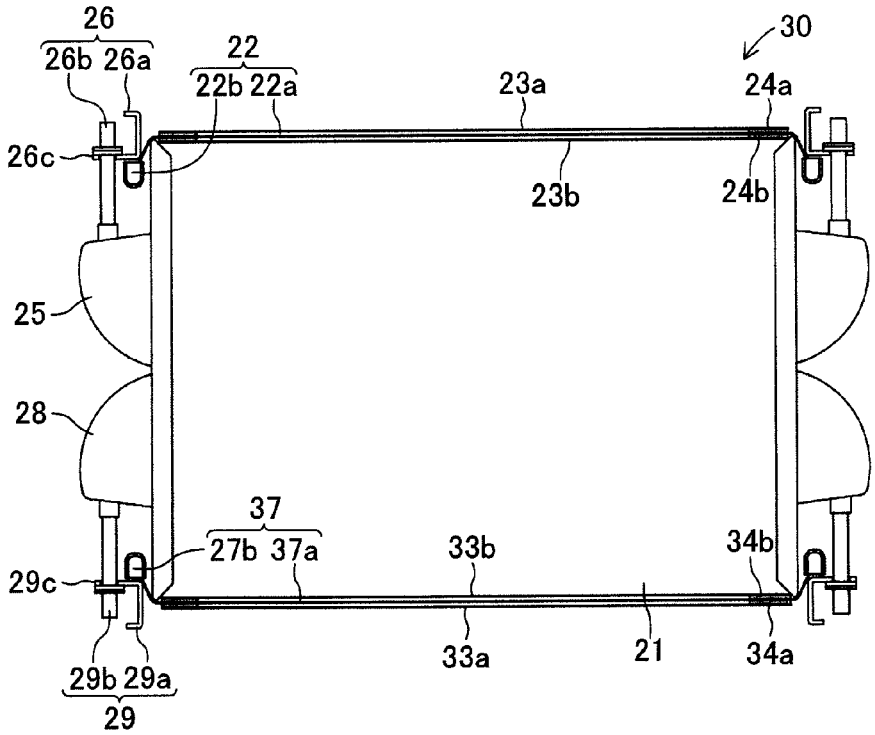
FIG. 15 is a section view of an acoustic drum according to the third embodiment of the present invention.

FIG. 15 indicates an acoustic drum 30 according to the third embodiment of the present invention. The acoustic drum 30 is designed such that to the front side (underside) of a head portion 37*a* of a resonance head 37, a non-striking surface attachment 33*a* is attached with a double-faced tape 34*a*, while a non-striking surface attachment 33*b* is attached to the reverse side (inner surface) of the head portion 37*a* with a double-faced tape 34*b*. The non-striking surface attachments 33*a* and 33*b* are configured similarly to the above-described striking surface attachments 23*a* and 23*b* to be attached to the head portion 37*a* by the similar manner by which the striking surface attachments 23*a* and 23*b* are attached. Except the non-striking surface attachments 33*a* and 33*b*, the acoustic drum 30 is configured similarly to the above-described acoustic drum 20. Therefore, similar components are given similar numerals to omit explanations of the components.

The acoustic drum 30 can achieve reduction in sound volume more efficiently than the acoustic drum 20. The operational advantage of the acoustic drum 30 other than the above is the same as that of the acoustic drum 20 of the second embodiment.

(Fourth Embodiment)

Figure 16:
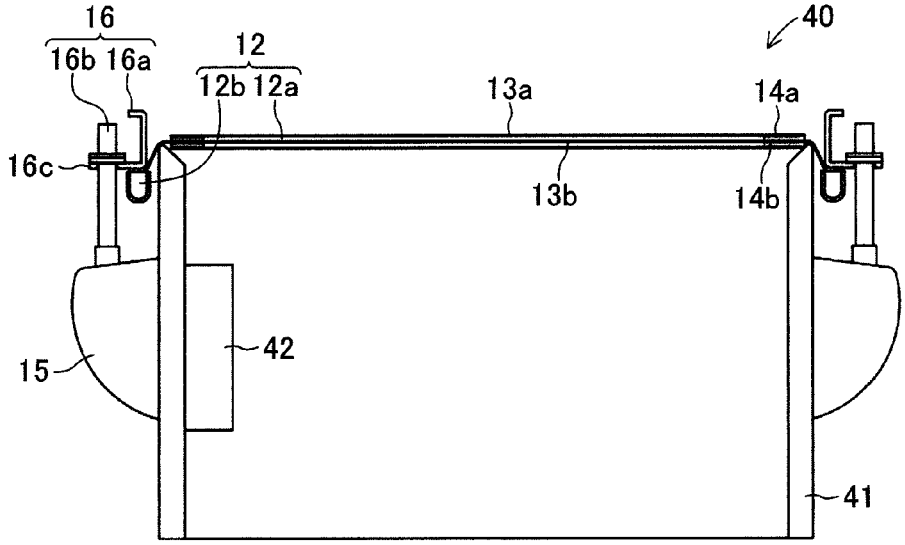
FIG. 16 is a section view of an acoustic drum according to the fourth embodiment of the present invention.

FIG. 16 indicates an acoustic drum 40 according to the fourth embodiment of the present invention. The acoustic drum 40 is designed such that a sound-absorbing member 42 is provided on a part of an inner peripheral surface of a shell 41. The sound-absorbing member 42 is formed of urethane foam having a thickness (lateral length) of 25 mm, a vertical length of 100 mm, a length of 150 mm measured along a circumferential direction of the inner peripheral surface of the shell 41, and a density of 20 kg/m$^3$. The sound-absorbing member 42 is attached with adhesive to be situated at the vertical center of the inner peripheral surface of the shell 41. Except the sound-absorbing member 42, the acoustic drum 40 is configured similarly to the above-described acoustic drum 10. Therefore, similar components are given similar numerals to omit explanations of the components.

Without hindering vibrations of the drumhead 12, the acoustic drum 40 can efficiently reduce internal resonance generated inside the shell 41. In a case where the drumhead 12 is made heavier by attaching the striking surface attachments 13*a* and 13*b*, furthermore, the internal resonance of the shell 41 tends to be reinforced. Although the internal resonance could be inconvenient, the resonance can be absorbed by the sound-absorbing member 42 provided on the shell 41. As a result, the acoustic drum 40 can generate comfortable struck sounds. The operational advantage of the acoustic drum 40 other than the above is the same as that of the acoustic drum 10 of the first embodiment.

(Fifth Embodiment)

Figure 17:
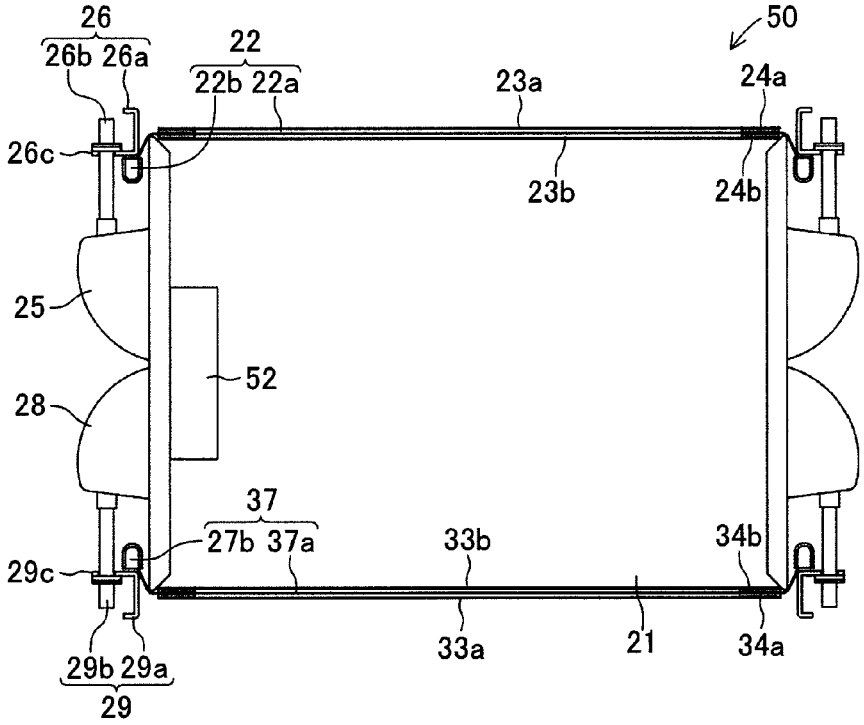
FIG. 17 is a section view of an acoustic drum according to the fifth embodiment of the present invention.

FIG. 17 indicates an acoustic drum 50 according to the fifth embodiment of the present invention. The acoustic drum 50 is designed such that a sound-absorbing member 52 configured similarly to the above-described sound-absorbing member 42 is provided on a part of an inner peripheral surface of a shell 51. Except the sound-absorbing member 52, the acoustic drum 50 is configured similarly to the above-described acoustic drum 30 of the third embodiment. Therefore, similar components are given similar numerals to omit explanations of the components. The acoustic drum 50 has higher effect on reduction in sound volume than the acoustic drums 10 to 40 of the above-described embodiments, also achieving reduction in resonance produced within the shell 51.

Figure 18:
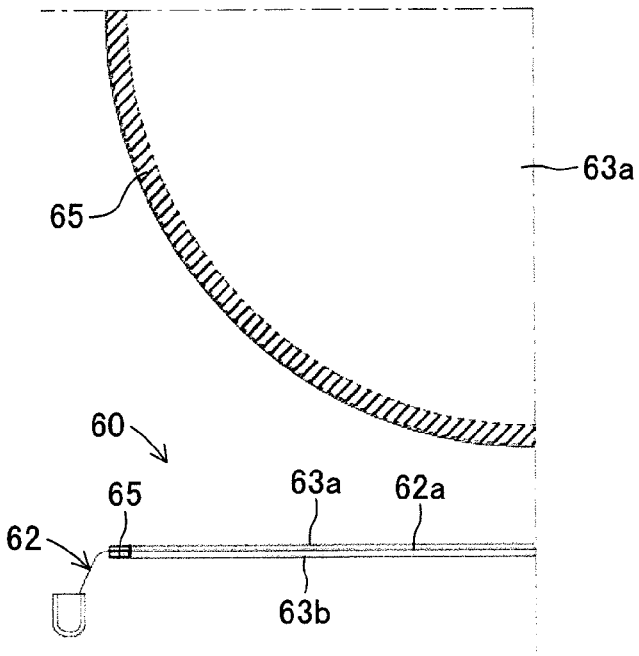
FIG. 18 is an illustration indicative of fixing portions of striking surface attachments fixed to a drumhead of an acoustic drum according to the first modification.

FIG. 18 indicates a main portion of an acoustic drum 60 according to the first modification of the above-described first embodiment. The acoustic drum 60 is designed such that respective fixing portions 65 by which striking surface attachments 63*a* and 63*b* are fixed to a head portion 62*a* of a drumhead 62 are respective outer areas of the striking surface attachments 63*a* and 63*b*, and have a width of 5 mm measured from the outer end of the striking surface attachments 63*a* and 63*b*. The acoustic drum 60 is also a 12-inch acoustic drum. For the acoustic drum of this size, the minimum width of the fixing portions 65 is defined at 5 mm, which is the minimum value that can prevent the striking surface attachments 63*a* and 63*b* from coming unstuck from the head portion 62*a* by tension and strikes. Therefore, the acoustic drum 60 can yield the maximum effect with the minimum fixing strength.

Figure 19:
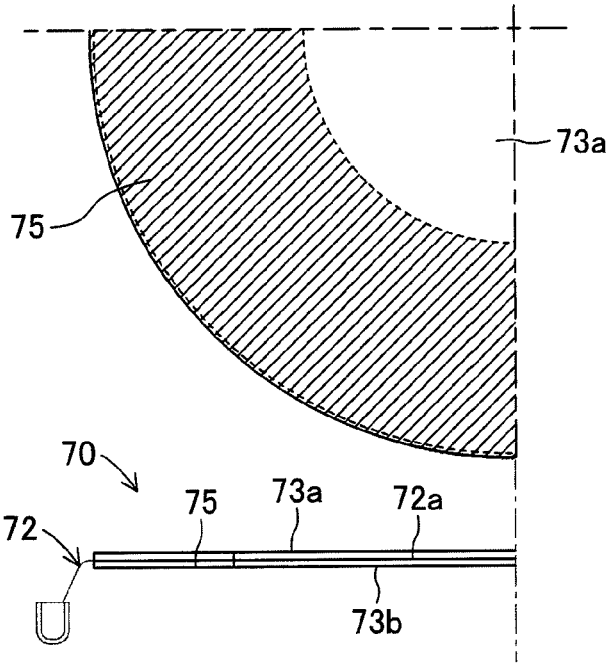
FIG. 19 is an illustration indicative of fixing portions of striking surface attachments fixed to a drumhead of an acoustic drum according to the second modification.

FIG. 19 indicates a main portion of an acoustic drum 70 according to the second modification of the above-described first embodiment. The acoustic drum 70 is designed such that respective fixing portions 75 by which striking surface attachments 73*a* and 73*b* are fixed to a head portion 72*a* of a drumhead 72 are respective outer areas of the striking surface attachments 73*a* and 73*b*, and have a width of 50% of the radius of the head portion 72*a*, ranging from the outer end of the striking surface attachments 73*a* and 73*b*. The acoustic drum 70 is also a 12-inch acoustic drum. For the acoustic drum of this size, the maximum width of the fixing portions 75 is defined at 50% of the radius of the head portion 72*a*. The thus designed acoustic drum 70 has the fixing portions 75 of the maximum area to securely prevent the striking surface attachments 73*a* and 73*b* from coming unstuck from the head portion 72*a*, also providing attack.

In other words, it is preferable that the width in the radius direction of the fixing portions of the 12-inch acoustic drum is set at any desired value falling within a range from 5 mm to 50% of the radius of the head portion. This range can be also applied to the acoustic drums 20 to 50 of the second to fifth embodiments. In addition, it is preferable that the width of the fixing portions of the non-striking surface attachments 33*a* and 33*b* of the third and fifth embodiments is set within this range. If the acoustic drum varies in size, the width of the fixing portions of the acoustic drum also varies according to the size. More specifically, the width of the fixing portions of the acoustic drum should be changed so as to make the width of the fixing portion be approximately proportional to the diameter of the acoustic drum. The range can be thus applied to any acoustic drums of various sizes.

Figure 20:
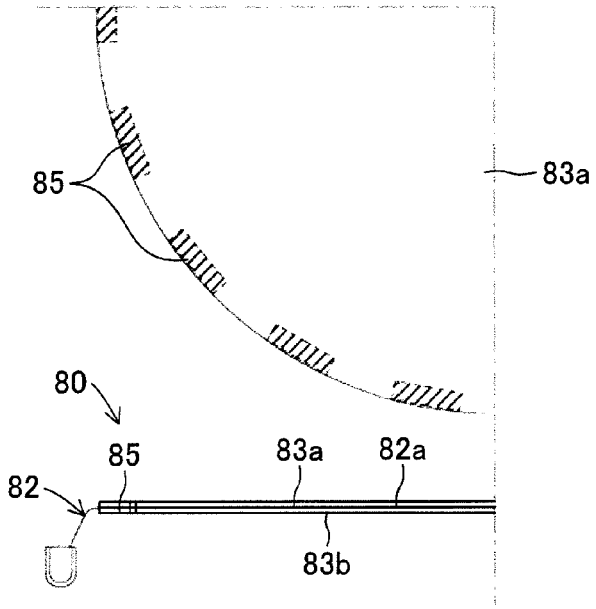
FIG. 20 is an illustration indicative of fixing portions of striking surface attachments fixed to a drumhead of an acoustic drum according to the third modification.

FIG. 20 indicates a main portion of an acoustic drum 80 according to the third modification of the above-described first embodiment. The acoustic drum 80 is designed such that respective fixing portions 85 by which striking surface attachments 83*a* and 83*b* are fixed to a head portion 82*a* of a drumhead 82 are formed not of one unit which is the entire outer area but of a plurality of parts which are apart from each other with regular intervals being provided between the parts. The fixing portions 85 make up 50% of the whole circumference to have a width of 10 mm. The acoustic drum 80 is also a 12-inch acoustic drum. The acoustic drum of this size can yield sufficient effect with the above-described fixing portions 85. The fixing portions 85 can be also applied to the acoustic drums 20 to 50 of the second to fifth embodiments. In addition, it is preferable that the width of the fixing portions of the non-striking surface attachments 33*a* and 33*b* of the third and fifth embodiments is set similarly.

Figure 21:
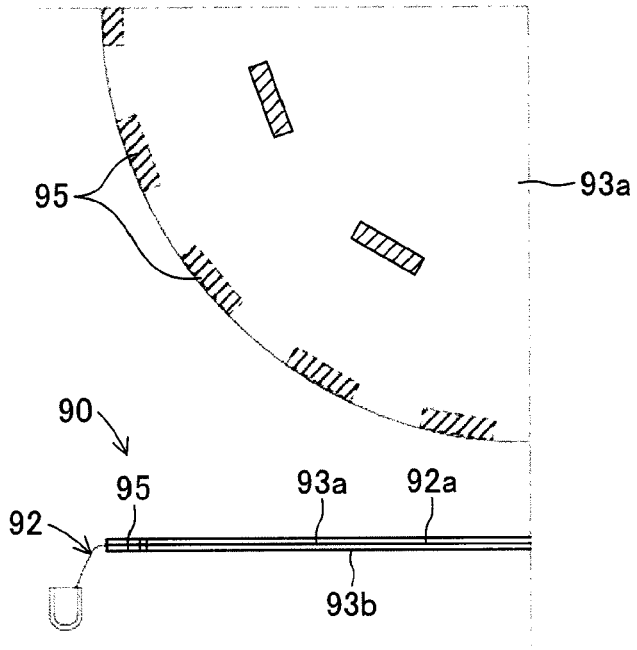
FIG. 21 is an illustration indicative of fixing portions of striking surface attachments fixed to a drumhead of an acoustic drum according to the forth modification.

FIG. 21 indicates a main portion of an acoustic drum 90 according to the fourth modification of the above-described first embodiment. The acoustic drum 90 is designed such that a fixing portion 95 by which striking surface attachments 93*a* and 93*b* are fixed to a head portion 92*a* of a drumhead 92 is formed of a plurality of parts which are provided on the outer area to be apart from each other with regular intervals being provided between the parts, and a plurality of parts provided inside the outer area. More specifically, the fixing portion 95 is formed of the parts configured similarly to the fixing portion 85, and the parts situated inside so that each of these parts will have the same size. Among the parts of the fixing portion 95, furthermore, the parts situated inside are located to be slightly closer to the outer rim to avoid the central portion of the drumhead 92 which is struck with the stick S. The acoustic drum 90 is also a 12-inch acoustic drum. The acoustic drum of this size can yield sufficient effect with the above-described fixing portion 95. The fixing portion 95 can be also applied to the acoustic drums 20 to 50 of the second to fifth embodiments.

Figure 22:
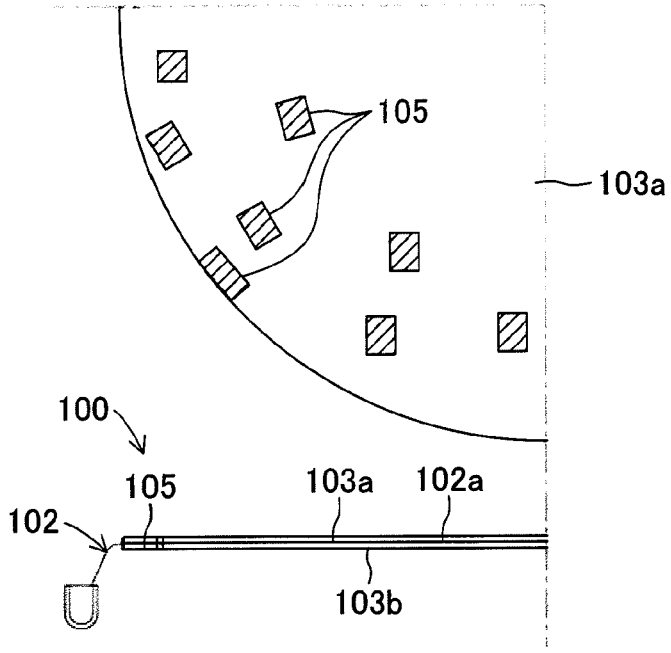
FIG. 22 is an illustration indicative of fixing portions of striking surface attachments fixed to a drumhead of an acoustic drum according to the fifth modification.

FIG. 22 indicates a main portion of an acoustic drum 100 according to the fifth modification of the above-described first embodiment. The acoustic drum 100 is designed such that a fixing portion 105 by which striking surface attachments 103*a* and 103*b* are fixed to a head portion 102*a* of a drumhead 102 is formed of a plurality of parts which are placed randomly on the outer area. The acoustic drum 100 can also yield sufficient effect with the above-described fixing portion 105. The fixing portion 105 can be also applied to the acoustic drums 20 to 50 of the second to fifth embodiments. As different modifications, furthermore, the sound-absorbing member 42, 52 may be used for the acoustic drums 10 to 30 of the first to third embodiments and their modifications.

The acoustic drum according to the present invention is not limited to the above-described embodiments and their modifications, but can be further modified. For instance, although the acoustic drum of each embodiment is designed such that the striking surface attachment 13*a* or the like is provided on the front side of the head portion 12*a* or the like with the striking surface attachment 13*b* or the like being provided on the reverse side of the head portion 12*a* or the like, the acoustic drum may be designed to have only the striking surface attachment 13*a* or the like, or only the striking surface attachment 13*b* or the like. Furthermore, the acoustic drum may be designed such that a plurality of striking surface attachments are provided on the front side or the reverse side of the head portion 12*a* or the like. Similarly, the acoustic drum may be designed to have one of the non-striking surface attachments 33*a* and 33*b*, or to have a plurality of non-striking surface attachments on the front side or the reverse side of the head portion 37*a*.

Furthermore, the way by which the striking surface attachments 13*a* and 13*b*, and the non-striking surface attachments 33*a* and 33*b* are fixed to the head portion 12*a* and the head portion 37*a* is not limited to adhesion by use of the double-faced tape 14*a* and the like, but may be fixing by use of a bonding adhesive or by use of a fixing member such as rivets or staples of stapler. Furthermore, the material of the head portions 12*a* and the like, the striking surface attachments 13*a* and the like, and the non-striking surface attachments 33*a* and the like is not limited to PET film, but may be any other high polymer film having characteristics similar to PET film such as PEN film. As the sound-absorbing member 42 and the like, not only urethane foam but also glass wool fiber material, sponge or the like can be used.

Furthermore, the drumhead 12 to which the striking surface attachments 13*a*, 13*b* and the like are attached, and the resonance head 37 to which the non-striking surface attachments 33*a*, 33*b* and the like are attached may be either previously incorporated into the acoustic drum or separately added. In the case of separately adding, it is preferable to prepare different kinds of drumheads and resonance heads so that a player can choose and use a player's desired one. In the different kinds of drumheads and resonance heads, the striking surface attachments 13*a*, 13*b* and the non-striking surface attachments 33*a*, 33*b* have different fixing portions respectively. For the striking surface attachments 13*a*, 13*b*, and the non-striking surface attachments 33*a*, 33*b* and the like, furthermore, by preparing different kinds of striking surface attachments and non-striking surface attachments having an adhesive agent or bonding adhesive on parts which are to be fixed to the drumhead and the resonance head, the player can choose player's desired striking surface attachments and non-striking surface attachments according to the player's purpose to fix the selected striking surface attachments and non-striking surface attachments to the drumhead and the resonance head. The different kinds of striking surface attachments and the non-striking surface attachments have different fixing portions respectively.

By adopting the above-described schemes, modes of use are widely broadened to improve usability of the acoustic drum. Furthermore, although the above-described embodiments and modifications are described as a 12-inch small acoustic drum, it goes without saying that the acoustic drum according to the present invention can be applied to acoustic drums of various sizes ranging from small acoustic drums to large acoustic drums irrespective of size. Furthermore, the other configurations of the acoustic drum 10 and the like can be also modified within the technical scope of the present invention.

What is claimed is:

1. An acoustic drum comprising:

a hollow cylindrical shell;

a drumhead mounted on one opening end of the shell to form a striking surface; and a striking surface attachment which is formed of a resin film to be placed on at least either a front side or a reverse side of the drumhead, wherein at least a part of an outer area of the striking surface attachment is fixed to the drumhead as a fixing portion without fixing a central area of the striking surface attachment to the drumhead.

2. The acoustic drum according to claim 1, wherein the striking surface attachment is placed over a surface of a movable part of at least a front side or a reverse side of the drumhead.

3. The acoustic drum according to claim 1, wherein the striking surface attachment is formed of the same material as a material of the drumhead.

4. The acoustic drum according to claim 1, wherein a width of the fixing portion in a radial direction falls within a range from 5 mm to 50% of a radius of the drumhead.

5. The acoustic drum according to claim 1, wherein the fixing portion is a whole circumference of the outer area of the striking surface attachment.

6. The acoustic drum according to claim 1, wherein the fixing portion is formed of a plurality of parts situated on the outer area of the striking surface attachment to be away with each other with intervals being provided in a circumferential direction.

7. The acoustic drum according to claim 1, wherein the fixing portion is formed of a plurality of parts scattered on the outer area of the striking surface attachment.

8. The acoustic drum according to claim 1, further comprising:

a resonance head mounted on the other opening end of the shell.

9. The acoustic drum according to claim 8, further comprising:

a non-striking surface attachment which is formed of a resin film to be placed on at least either a front side or a reverse side of the resonance head, wherein at least a part of an outer area of the non-striking surface attachment is fixed to the resonance head without fixing a central area of the non-striking surface attachment to the resonance head.

10. The acoustic drum according to claim 9, wherein one of resonance heads to which non-striking surface attachments each having a different fixing portion are attached, respectively, is selectively attached to the shell.

11. The acoustic drum according to claim 9, wherein one of non-striking surface attachments each having a different fixing portion is selectively fixed to the resonance head.

12. The acoustic drum according to claim 1, further comprising:

a sound-absorbing member placed on a part of an inner surface of the shell.

13. The acoustic drum according to claim 1, wherein one of drumheads to which striking surface attachments each having a different fixing portion are attached, respectively, is selectively attached to the shell.

14. The acoustic drum according to claim 1, wherein one of striking surface attachments each having a different fixing portion is selectively fixed to the drumhead.

* * * * *